United States Patent [19]

Drever

[11] Patent Number: 4,966,252

[45] Date of Patent: Oct. 30, 1990

[54] MICROPHONE WINDSCREEN AND METHOD OF FABRICATING THE SAME

[76] Inventor: Leslie C. Drever, 7760 Burnet Ave., Van Nuys, Calif. 91405

[21] Appl. No.: 399,142

[22] Filed: Aug. 28, 1989

[51] Int. Cl.[5] ..... G10K 11/00; H04R 7/00

[52] U.S. Cl. ..... 181/158; 181/242; 381/158; 381/169; 381/189; 381/205

[58] Field of Search ..... 181/157, 158, 242; 381/169, 158, 189, 205

[56] References Cited

U.S. PATENT DOCUMENTS

| | | | |
|---|---|---|---|
| 1,901,065 | 3/1933 | Spotts | 381/158 X |
| 2,536,261 | 1/1951 | Caldwell, Jr. | 381/158 |
| 2,857,013 | 10/1958 | Orso | 181/242 |
| 3,154,171 | 10/1964 | Knutson et al. | 181/158 |
| 3,862,377 | 1/1975 | Burroughs | 381/169 |

*Primary Examiner*—Benjamin R. Fuller
*Attorney, Agent, or Firm*—John J. Posta, Jr.

[57] ABSTRACT

The microphone windscreen has a smooth level outer surface with decreased wind resistance and enhanced acoustic properties. The screen includes a resilient, hollow tubular body member of metal or plastic or the like, preferably polyethylene plastic, having a central space to hold a microphone and open front and rear ends. The sidewall of the member has a plurality of spaced openings to form a mesh configuration. A similarly constructed pair of hemispherical hollow end caps are welded or molded directly to the body by a weld or mold line to form the windscreen into a strong unitary porous cage structure, having decreased weight in comparison to conventional windscreens, and with reduced sound obstruction. The weld line is part of the smooth level outer surface of the windscreen. The inner surface of the windscreen is preferably covered by a wind noise attenuation medium such as a fabric formed of an outer layer of napped nylon, an intermediate layer of polymeric plastic foam and an inner layer of woven nylon. The windscreen is inexpensive, durable and not subject to breakage in constrast to conventional multi-component windscreens.

6 Claims, 1 Drawing Sheet

MICROPHONE WINDSCREEN AND METHOD OF FABRICATING THE SAME

BACKGROUND OF THE INVENTION

1. FIELD OF THE INVENTION

The present invention generally relates to sound devices and more particularly to an improved microphone windscreen.

2. PRIOR ART

A wide variety of applications in science, industry and entertainment require high quality reproduction of sound using available sound recording techniques and equipment. High-quality, low-noise sound reproductions, for example, are of critical importance in the television and movie industry. There, crisp, clean voice and dialogue reproduction must be achieved despite ambient and background noise levels of moderate to high amplitude.

One frequently encountered source of undesirable background noise is caused by air moving relative to the sound transducing device, which is most typically an omnidirectional or unidirectional microphone. As a result, a "whooshing" or rushing sound is imposed on the desired audio, thus resulting in deteriorated sound quality.

This type of noise may occur due to environmental or operational requirements and conditions. For example, wind noise often occurs when a microphone is panned during an indoor shoot, whether on a boom or simply held in hand with an extension. Likewise, such noise may be caused by forced air movement such as by fans or dynamic special effects equipment.

In certain applications, such as speeches or movie productions, unidirectional microphones are used which can reject most rear and lateral wind noise. However, this reduction is only effective at very low relative velocities, and will not reduce head-on wind noise. Further, unidirectional microphones are not suitable for all applications.

There are several prior art schemes that have been employed in an attempt to eliminate or reduce microphone wind noises. One is the use of a foam "sock" which is pulled over the microphone head. However, foam socks tend to physically deteriorate over time. As a result, foam particulates often fall into the microphone head, causing damage and reduced performance. Also, foam socks suffer the drawback of only being effective to reduce wind noise due to very slight breezes, up to approximately three miles per hour. This is a severe limitation in a broad spectrum of standard outdoor and indoor operating environments essential to the film and television industry. To overcome this limitation, electronic filtering techniques have been used to filter out wind noise resulting from velocities exceeding three miles per hour. Unfortunately, electronic filtering also attenuates desired audio frequencies, thereby substantially degrading sound quality.

An improved form of microphone windscreen is disclosed in U.S. Pat. No. 4,600,077. That device is slidably receivable for resiliently retaining the wind shroud in place. The mounting means incorporates a combination closed-cell and open-cell foam suspension support sections.

The wind shroud of the patent is a narrow cylindrical body which aligns with the shape of the microphone and can therefore fit between the narrow spaces provided between the microphone mount and the camera in modern video camera equipment. A grid-like structure covered with a multilayer laminate material provides for attenuation of undesired wind noise of speeds of up to 25 miles per hour while allowing desired audio frequencies, such as speech and music to pass freely to the transducer element of the microphone. A microphone wind shroud thus is provided that can easily and inexpensively manufactured while providing superior attenuation over prior art attenuation methods. Moreover, it is compact enough to be used with modern day microphones mounted to mini-camera equipment.

Unfortunately the wind shroud (windscreen) is fabricated of three separate pieces joined together in a manner which makes them subject to breakage if and when the wind shroud is bumped, dropped or otherwise distorted. In this regard, the tubular main body of the device has at one end thereof an end cap abutting it and held in place thereagainst by a raised plastic ring. At the opposite end of the main body a raised plastic cup or fitting (mount) is glued to the main body. The resulting uneven outer surface of the device has higher than optimal wind resistance. Thus, it causes wind to deflect therefrom and results in some undesired wind noise, including a sibilance and/or rumble.

Accordingly, there remains a need for an improved microphone windscreen which is strong, resilient, resistant to crushing and other breakage and has improved low wind resistance and improved acoustical properties. The wind screen should be inexpensive, durable and efficient.

SUMMARY OF THE INVENTION

The improved microphone windscreen of the present invention satisfies all the foregoing needs. The windscreen is made in accordance with the method of the present invention. The windscreen and method of fabrication thereof are substantially as set forth in the Abstract of the Disclosure.

Thus, the windscreen comprises a hollow tubular body with a central space to hold a microphone and open opposite front and rear ends against which are secured, by a small weld line or mold line, preferably hemispherical hollow end caps to form a resilient unitary structure with a smooth, level outer surface throughout its entirety. The present method includes heating the tubular body and end caps, aligning and abutting them and joining them by laying down a molten weld line or mold line, cooling and solidifying the components to form the unitary structure.

The outer surface of the windscreen is discontinuous only to the extent that it has spaced openings communicating with the central space so that the body and end caps comprise a cage or mesh of porous webbing having strength and resistance to breakage. The webbing is of metal or plastic, preferably the latter. The windscreen has reduced resistance to wind and therefore wind noise is decreased. The inner surface of the windscreen may be lined with a wind attenuation fabric comprising an outer layer of, for example, nylon napping, an intermediate layer of polyurethane foam or the like, and an inner layer of nylon cloth. Other wind noise attenuation, sound transmitting fabrics can also be used.

Various other features of the present improved windscreen and its method of fabrication are set forth in the following detailed description and accompanying drawings.

DRAWINGS

DETAILED DESCRIPTION

FIGS. 1–4

Figure 1:
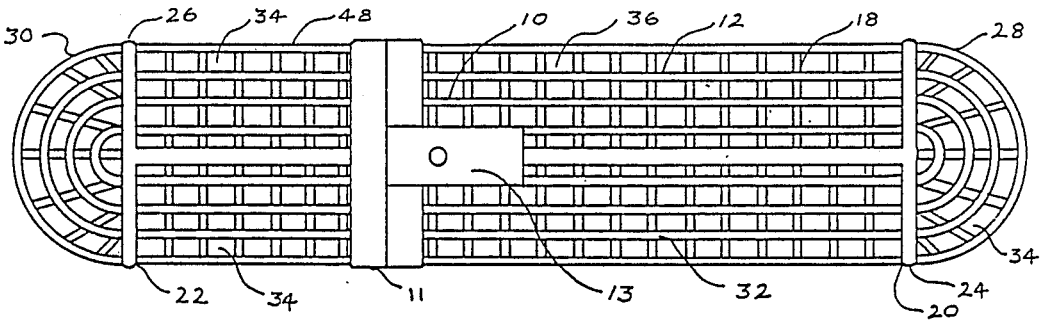
FIG. 1 is a schematic side elevation, partly broken away, of a preferred embodiment of the improved windscreen of the present invention connected to a holder.
Figure 2:
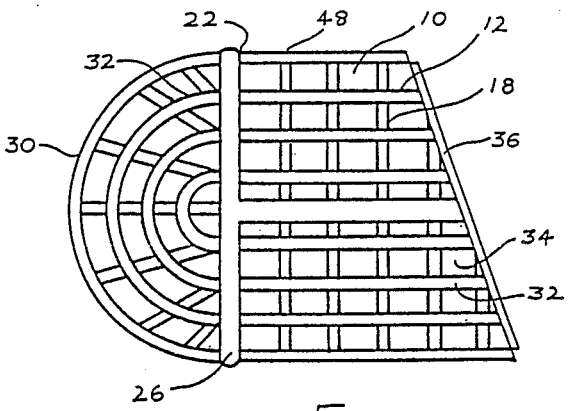
FIG. 2 is an enlarged schematic fragmentary side elevation, partly broken away, of the windscreen of FIG. 1.
Figure 3:
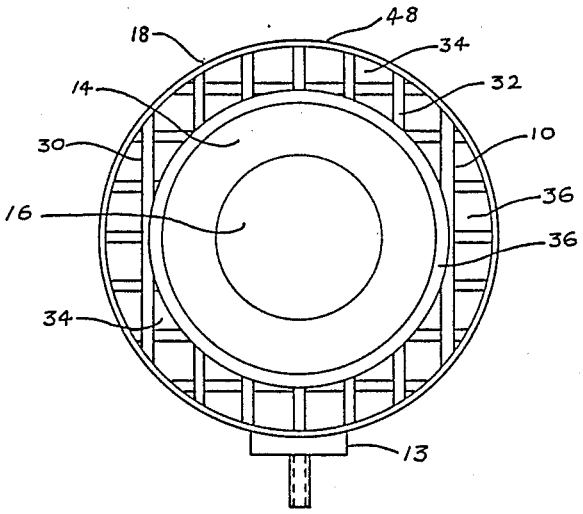
FIG. 3 is an enlarged schematic end view, partly broken away, of one of the end caps of the windscreen of FIG. 1; and, FIG. 4 is a greatly enlarged schematic fragmentary cross-section of the fabric liner connected to the inner surface of the windscreen of FIG. 1.
Figure 4:
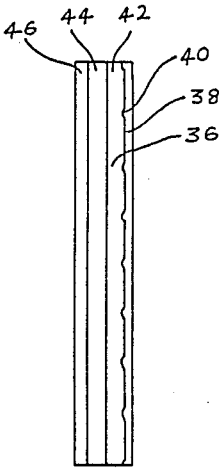

A preferred embodiment of the improved microphone windscreen of the present invention is schematically depicted in FIGS. 1-4. Thus, windscreen 10 is shown in FIG. 1 connected to a mounting ring 11 and bracket 13. Windscreen 10 comprises an elongated, hollow preferably cylindrical tubular main body member 12 having a central space 14 within which a microphone 16 may be loosely or snugly received (FIG. 3). Space 14 is defined by annular sidewall 18 having open opposite front and rear ends 20 and 22 to which are joined at weld lines or mold lines 24 and 26, respectively, preferably hemispherical hollow end caps 28 and 30.

Member 12 and end caps 28 and 30 are of similar construction, each comprising an outer cage or web of strong resilient metal, such as steel, aluminum, titanium, etc., or plastic, mesh material, preferably thermoplastic such as polyethylene, polypropylene or the like, defining regularly spaced openings 34 therein acoustically communicating with central space 14 through, preferably, a liner 36 of wind noise attenuating fabric connected to the inner surface 38 of mesh 32 by a plurality of spots or a layer 40 of glue or the like, preferably adhering only to mesh 32 and not disposed in openings 34.

Fabric liner 36 preferably comprises an outer layer 42 of napped or felted nylon, polyester or cellulosic fibers or the like connected to an intermediate layer 44 of polyurethane foam, foamed polystyrene or other foamed plastic material, in turn connected to an inner layer 46 of woven nylon or other cloth, such as cellulosic fiber, polyester fiber, etc. It will be understood that liner 36 could comprise additional or fewer layers of the described or other materials to achieve its desired function of blocking wind from striking microphone 16 while not impeding the passage of sound through windscreen 10 to microphone 16.

When windscreen 10 is fabricated in accordance with the present method, the prefabricated member 12 and end caps 28 and 30 with liner 36 already in place on the inner surfaces 38 thereof, are heated sufficiently to facilitate the proper bonding to be carried out by the method. The heated member 12 and end caps 28 and 30 are aligned and joined so as to about abut each other to form the configuration of FIG. 1. While they are being held in such alignment, and while they are heated, semi-molten or molten metal weld lines or plastic molding material lines 24 and 26 are laid down at the joints and cooled and solidified in place. As can be seen in FIGS. 1 and 2, such weld or mold lines 24 and 26 form an integral part of the outer surface 48 of windscreen 10, which surface is essentially level, smooth and without rings, bumps, connectors and ridges, so that the wind resistance of screen 10 is minimal, in contrast to conventional windscreens which require rings and connectors to attach their components together.

The welding/molding step can be carried out in one or two stages. Thus, end caps 28 and 30 can be sequentially or simultaneously connected to member 12 either by hand or machine, in the latter case preferably a machine which preheats the rotating aligned components while laying down flowable extrusion heads as circumferential lines 24 and 26 around screen 10. Smoothing of lines 24 and 26 is mechanically or automatically effected so that they blend with and form part of outer surface 48 and are not raised ridges which would increase the wind resistance of screen 10.

This method results in a unitary structure which is very strong and not subject to breakage, is flexible and has no weak points. The weight of windscreen 10 is reduced by about 15 percent by fabricating in accordance with the present method, when compared with conventional windscreens, and the appearance of windscreen 10 is also greatly improved over conventional windscreens. Of more importance, windscreen 10 has substantially reduced wind resistance, so that wind sibilance and rumble are reduced. Extremely low sound bounce is achieved. High wind noise attenuation is achieved with the combination of the outer mesh layer 32 and the inner attenuation liner 36. Accordingly, windscreen 10 represents a substantial improvement in the art.

Various modifications, changes, alterations and additions can be made in the improved microphone windscreen of the present invention, its components and parameters. All such modifications, changes, alterations and additions as are within the scope of the appended claims form part of the present invention.

What is claimed is:

1. An improved microphone windscreen with a smooth level outer surface and enhanced acoustic properties, said windscreen comprising, in combination:

(a) a resilient tubular body member having open opposite front and rear ends and a sidewall defining a central space, said sidewall having a plurality of spaced openings extending therethrough, in communication with said space, said body member being adapted to house a microphone in said central space and protect said microphone from wind;

(b) resilient hollow curved front and rear end caps, each comprising a shell having a plurality of spaced openings extending therethrough, said end caps being welded or molded directly to said body member by a weld line at each of said front and rear ends to form a unitary structure having a smooth level outer surface throughout with lower wind resistance, improved strength and lower weight and with reduced sound obstruction.

2. The improved microphone windscreen of claim 1 wherein an inner surface of said screen is lined with a wind noise attenuation medium comprising a fabric.

3. The improved microphone wind screen of claim 2 wherein said fabric comprises a layer of napped nylon next to said screen, an intermediate layer of polymeric plastic foam and an inner layer of woven nylon.

4. The improved microphone and windscreen wherein said tubular body member, end caps and weld line are of the same material and comprise plastics and wherein said tubular body caps and weld line form a porous cage.

5. The improved windscreen of claim 4 wherein said material comprises thermoplastic.

6. The improved windscreen of claim 5 wherein said thermoplastic comprises polyethylene and wherein said end caps are generally hemispherical.

* * * * *